US007112922B2

(12) United States Patent
Tachibana et al.

(10) Patent No.: US 7,112,922 B2
(45) Date of Patent: Sep. 26, 2006

(54) AC SURFACE DISCHARGE TYPE PLASMA DISPLAY PANEL

(75) Inventors: Hiroyuki Tachibana, Suita (JP); Tomohiro Murakoso, Akashi (JP); Yasuyuki Noguchi, Takatsuki (JP); Tetsuya Shirai, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/505,077

(22) PCT Filed: Mar. 25, 2004

(86) PCT No.: PCT/JP2004/004143

§ 371 (c)(1),
(2), (4) Date: Aug. 20, 2004

(87) PCT Pub. No.: WO2004/086447

PCT Pub. Date: Oct. 7, 2004

(65) Prior Publication Data

US 2005/0104807 A1 May 19, 2005

(30) Foreign Application Priority Data

Mar. 27, 2003 (JP) ..... 2003-088459

(51) Int. Cl.
*H01J 17/49* (2006.01)

(52) U.S. Cl. ..... 313/582; 313/583; 313/586; 313/587

(58) Field of Classification Search ..... 313/582, 313/583, 586, 587
See application file for complete search history.

(56) References Cited

U.S. PATENT DOCUMENTS

| | | | | |
|---|---|---|---|---|
| 5,754,004 | A * | 5/1998 | Miyagawa et al. | 313/585 |
| 6,313,580 | B1 * | 11/2001 | Makino | 313/582 |
| 6,496,167 | B1 * | 12/2002 | Makino | 345/60 |
| 6,674,238 | B1 * | 1/2004 | Otani et al. | 313/587 |
| 2001/0050534 | A1 * | 12/2001 | Amemiya et al. | 313/586 |
| 2003/0011307 | A1 * | 1/2003 | Otani et al. | 313/582 |
| 2005/0040766 | A1 * | 2/2005 | Tachibana et al. | 313/586 |
| 2005/0146274 | A1 * | 7/2005 | Tachibana et al. | 313/585 |
| 2005/0151476 | A1 * | 7/2005 | Tachibana et al. | 313/585 |
| 2005/0156524 | A1 * | 7/2005 | Tachibana et al. | 313/586 |

FOREIGN PATENT DOCUMENTS

| | | |
|---|---|---|
| JP | 11-297211 | 10/1999 |
| JP | 2001-195990 | 7/2001 |
| JP | 2002-110051 | 4/2002 |
| JP | 2002-297091 | 10/2002 |

* cited by examiner

*Primary Examiner*—Nimeshkumar D. Patel
*Assistant Examiner*—Peter Macchiarolo
(74) *Attorney, Agent, or Firm*—Steptoe & Johnson LLP

(57) ABSTRACT

A plasma display panel has address properties stabilized. A priming discharge is performed between auxiliary electrodes (17), which are formed on a front substrate (1) and coupled with scan electrodes (6) and priming electrodes (14) formed on a back substrate (2). Furthermore, a material layer (5) containing at least one of alkali metal oxide, alkaline earth metal oxide and fluoride is provided on regions corresponding to priming discharge spaces (30) (gap parts 13) on the back substrate (2). As a result, the priming discharge has a wider margin, and a supply of priming particles to the discharge cells is stabilized, whereby a discharge delay during the addressing is reduced, and the address properties are stabilized.

4 Claims, 7 Drawing Sheets

AC SURFACE DISCHARGE TYPE PLASMA DISPLAY PANEL

TECHNICAL FIELD

The present invention relates to plasma display panels used for wall-hung TVs and large-size monitors.

BACKGROUND ART

An AC surface discharge type plasma display panel (hereinafter referred to as PDP), which is a typical AC type PDP, is formed of a front plate made of a glass substrate having scan electrodes and sustain electrodes provided thereon for a surface discharge, and a back plate made of a glass substrate having data electrodes provided thereon. The front plate and the back plate are disposed to face each other in parallel in such a manner that the electrodes on both plates form a matrix, and that a discharge space is formed between the plates. And the outer part of the plates thus combined is sealed with a sealing member such as a glass frit. Between the substrates, discharge cells partitioned by barrier ribs are formed, and phosphor layers are provided in the cell spaces formed by the barrier ribs. In a PDP with this structure, ultraviolet rays are generated by gas discharge and used to excite and illuminate phosphors for red, green and blue, thereby performing a color display (See Japanese Laid-Open Patent Application No. 2001-195990).

In this PDP, one field period is divided into a plurality of sub fields, and sub fields during which to illuminate phosphors are combined so as to drive the PDP for a gradation display. Each sub field consists of an initialization period, an address period and a sustain period. For displaying image data, each electrode is applied with signals different in waveform between the initialization, address and sustain periods.

In the initialization period, all scan electrodes are applied with, e.g. a positive pulse voltage so as to accumulate a necessary wall charge on a protective film provided on a dielectric layer covering the scan electrodes and the sustain electrodes, and also on the phosphor layers.

In the address period, all scan electrodes are scanned by being sequentially applied with a negative scan pulse, and when there are display data, a positive data pulse is applied to the data electrodes while the scan electrodes are being scanned. As a result, a discharge occurs between the scan electrodes and the data electrodes, thereby forming a wall charge on the surface of the protective film provided on the scan electrodes.

In the subsequent sustain period, for a set period of time, a voltage enough to sustain a discharge is applied between the scan electrodes and the sustain electrodes. This voltage application generates a discharge plasma between the scan electrodes and the sustain electrodes, thereby exciting and illuminating phosphor layers for a set period of time. In a discharge space where no data pulse has been applied during the address period, no discharge occurs, causing no excitation or illumination of the phosphor layers.

In this type of PDP, a large delay in discharge occurs during the address period, thereby making the address operation unstable, or completion of the address operation requires a long address time, thereby spending too much time for the address period. In an attempt to solve these problems, there have been provided a PDP in which auxiliary discharge electrodes are provided on a front plate, and a discharge delay is reduced by a priming discharge generated by an in-plane auxiliary discharge on the front plate side, and a method for driving the PDP (See Japanese Laid-Open Patent Application No. 2002-297091).

However, in these conventional PDPs, when the number of lines is increased as a result of achieved higher definition, more time must be spent for the address time and less time must be spent for the sustain period, thereby making it difficult to secure brightness when higher definition is achieved. Furthermore, when the partial pressure of xenon (Xe) is increased to achieve higher brightness and higher efficiency, a discharge initiation voltage rises, thereby making an initializing discharge unstable. This may cause a write error, thereby narrowing the driving voltage margin of a write operation.

The present invention, which has been contrived in view of the aforementioned problems, has an object of providing a PDP which stably generates a priming discharge, thereby making an initializing operation or an address operation stable, even when high definition is achieved or the partial pressure of xenon (Xe) is increased.

SUMMARY OF THE INVENTION

In order to achieve the object, a PDP of the present invention comprises: a first electrode and a second electrode which are disposed in parallel with each other on a first substrate; a third electrode disposed on a second substrate in a direction crossing the first electrode and the second electrode, the second substrate being disposed to face the first substrate with a discharge space therebetween; a fourth electrode disposed on the second substrate in such a manner as to be parallel with the first electrode and the second electrode; and a first discharge space and a second discharge space which are formed on the second substrate by being partitioned by a barrier rib, wherein the first discharge space forms a main discharge space for performing a discharge with the first electrode, the second electrode and the third electrode, and the second discharge space forms a priming discharge space for performing a discharge with the fourth electrode and at least one of the first electrode and the second electrode, and in the priming discharge space, a material layer containing at least one of alkali metal oxide, alkaline earth metal oxide and fluoride is provided on a discharge space side of the fourth electrode.

In this structure, at the time of a priming discharge performed by making the electrodes provided on the second substrate side function as cathodes, providing a material layer containing at least one of alkali metal oxide, alkaline earth metal oxide and fluoride can largely reduce a discharge voltage in priming discharge, and can also make discharge generation uniform. As a result, a priming discharge is stably formed while reducing influence on the surroundings such as crosstalk by increasing the operating margin of a priming discharge and reducing a discharge voltage. This achieves a PDP with excellent address properties to be compatible with high definition.

DETAILED DESCRIPTION OF PREFERRED EMBODIMENTS

A PDP according to each embodiment of the present invention will be described as follows with reference to accompanying drawings.

First Exemplary Embodiment

Figure 1:
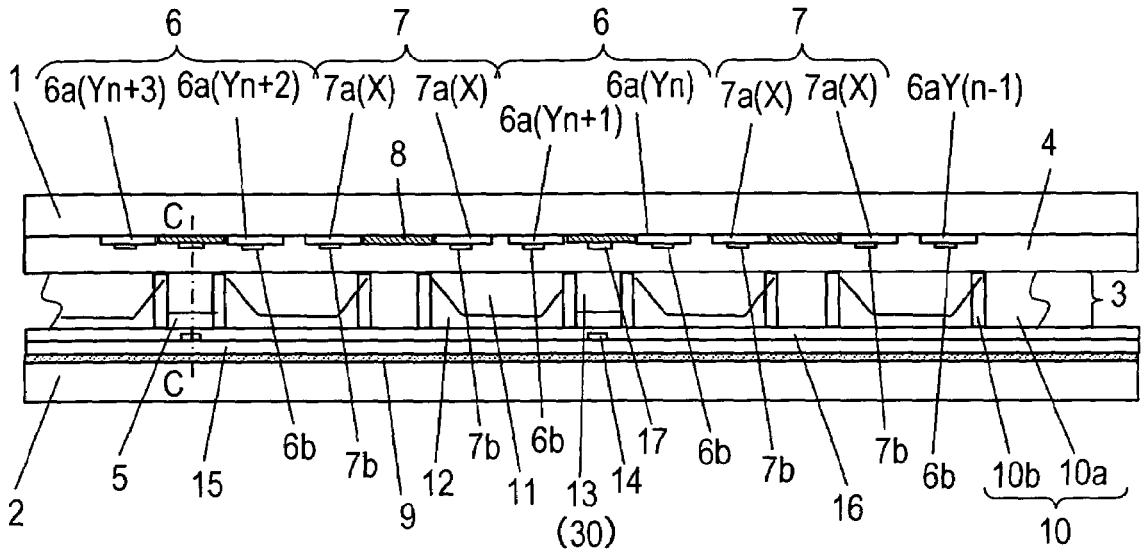
FIG. 1 is a cross sectional view of a PDP according to a first embodiment of the present invention.
Figure 2:
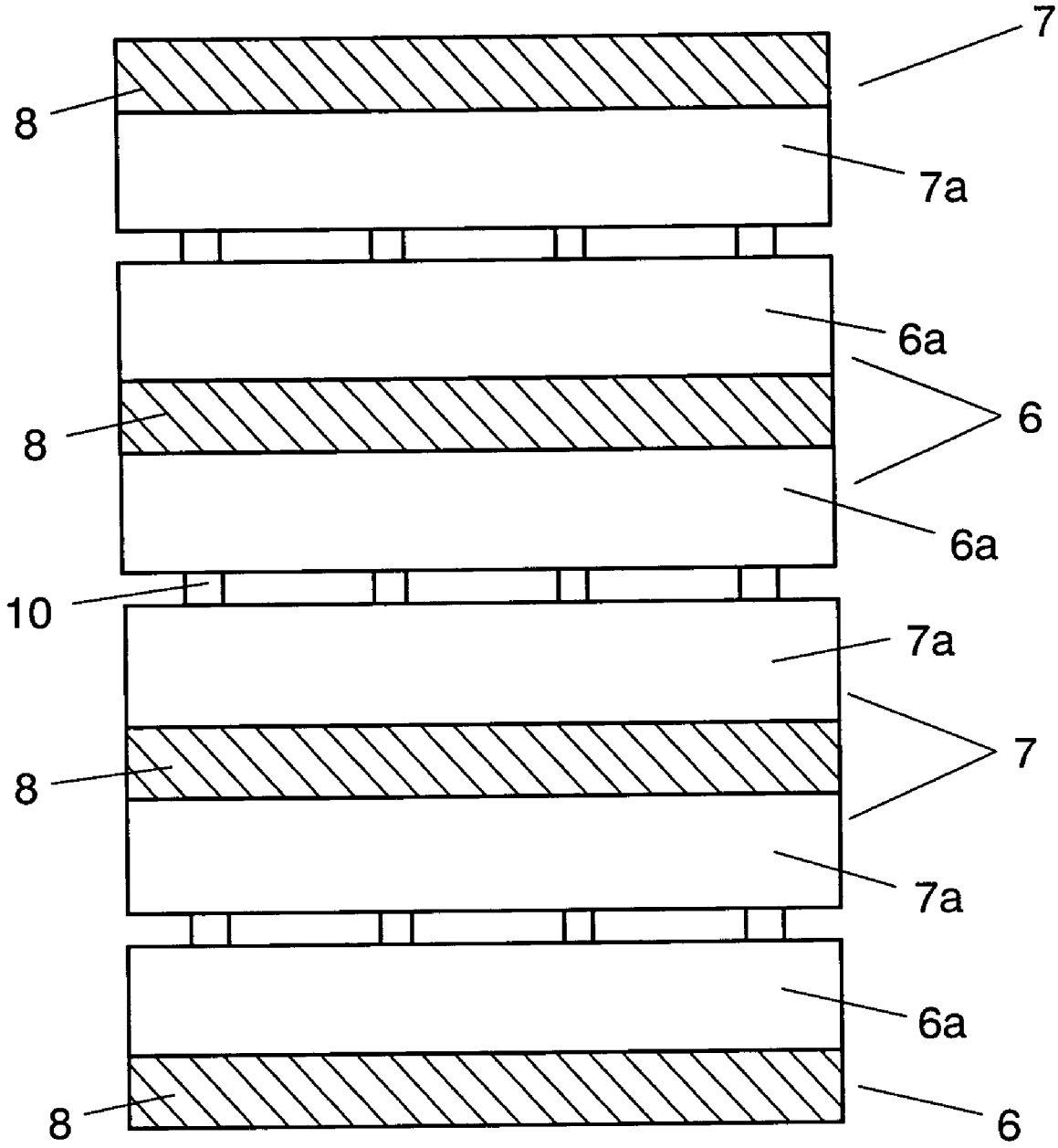
FIG. 2 is a schematic plan view showing an electrode arrangement on a front substrate side of the PDP according to the first embodiment of the present invention.
Figure 3:
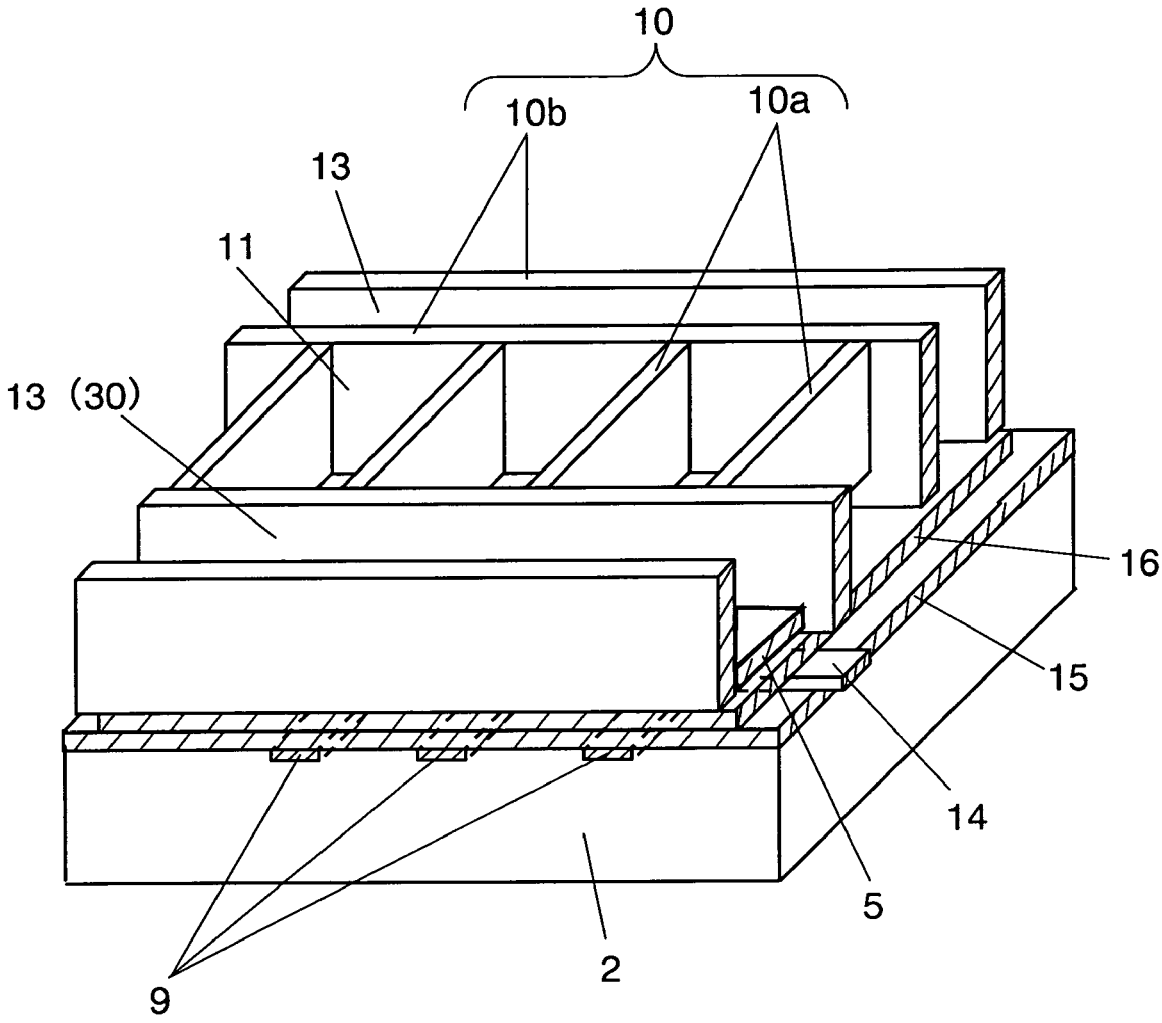
FIG. 3 is a schematic perspective view showing a back substrate side of the PDP according to the first embodiment of the present invention.
Figure 4:
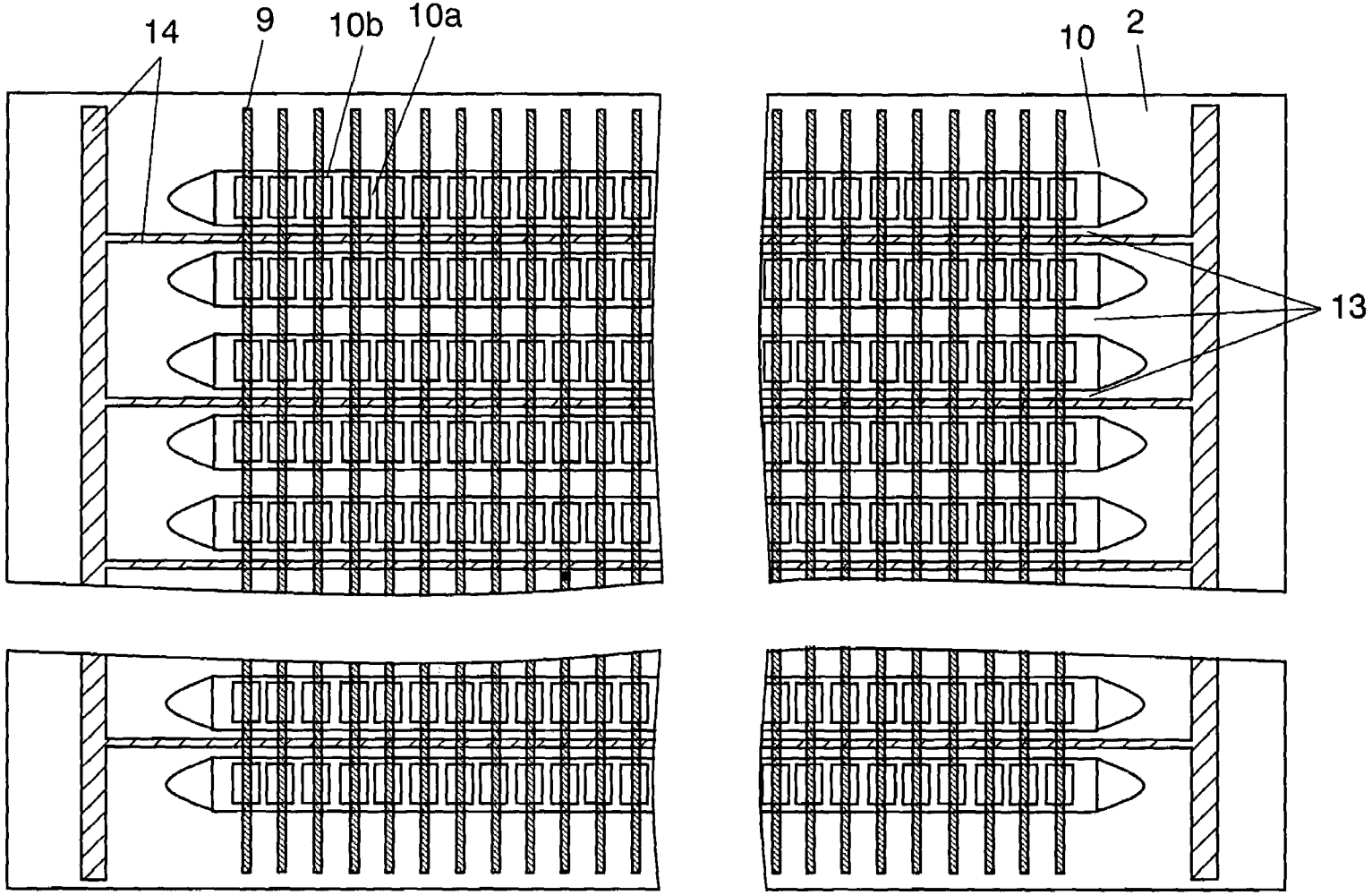
FIG. 4 is a schematic plan view showing a back substrate side of the PDP according to the first embodiment of the present invention.

FIG. 1 is a cross sectional view of a PDP according to a first embodiment of the present invention, FIG. 2 is a schematic plan view showing an electrode arrangement on a front substrate side, which is a first substrate side, FIG. 3 is a schematic perspective view showing a back substrate side, which is a second substrate side and FIG. 4 is a plan view thereof.

As shown in FIG. 1, front substrate 1 which is a first substrate made of glass, and back substrate 2 which is a second substrate made of glass are disposed to face each other with discharge space 3 therebetween, and discharge space 3 is sealed with neon (Ne), xenon (Xe) and the like as gasses for irradiating ultraviolet rays by discharge. On front substrate 1, a group of belt-shaped electrodes consisting of pairs of scan electrodes 6 as first electrodes and sustain electrodes 7 as second electrodes are disposed in parallel with each other in such a manner as to be covered with dielectric layer 4 and a protective layer (not illustrated). Scan electrodes 6 and sustain electrodes 7 are respectively formed of transparent electrodes 6*a* and 7*a*, and metal bus bars 6*b* and 7*b*, which are respectively laid on transparent electrodes 6*a* and 7*b*, and which are made of silver or the like for improving conductivity. As shown in FIGS. 1 and 2, scan electrodes 6 and sustain electrodes 7 are disposed alternately, two by two, so that scan electrode 6—scan electrode 6—sustain electrode 7—sustain electrode 7, . . . are arranged in that order, and auxiliary electrodes 17 are each provided between two adjacent scan electrodes 6. In addition, light absorption layers 8 for improving a contrast at the time of illumination are each disposed between two adjacent sustain electrodes 7, and between two adjacent scan electrodes 6. Auxiliary electrodes 17 are connected with scan electrodes 6 at a non-display part (end part) of the PDP. As shown in FIGS. 1, 3 and 4, back substrate 2 is provided thereon with a plurality of belt-shaped data electrodes 9 which are third electrodes disposed in parallel with each other in the direction orthogonal to scan electrodes 6 and sustain electrode 7. Back substrate 2 is further provided thereon with barrier ribs 10 for partitioning a plurality of discharge cells formed by scan electrodes 6, sustain electrodes 7 and data electrodes 9. Barrier ribs 10 are formed of longitudinal rib parts 10*a* extending in the direction orthogonal to scan electrodes 6 and sustain electrodes 7 provided on front substrate 1, namely in the direction parallel to data electrodes 9, and of lateral rib parts 10*b* crossing longitudinal rib parts 10*a* to form main discharge cells 11 which are first discharge spaces, and also to form gap parts 13 between main discharge cells 11. Main discharge cells 11 are provided with phosphor layers 12.

As shown in FIG. 3, gap parts 13 formed on back substrate 2 are continuous in the direction orthogonal to data electrodes 9. And priming electrodes 14 which are fourth electrodes for causing a discharge between front substrate 1 and back substrate 2 are disposed, in the direction orthogonal to data electrodes 9, exclusively in gap parts 13 corresponding to regions where scan electrodes 6 are adjacent to each other, thereby forming priming discharge spaces 30 which are second discharge spaces. Priming electrodes 14 are formed on dielectric layer 15 covering data electrodes 9, and dielectric layer 16 is formed to cover priming electrodes 14. Thus, priming electrodes 14 are disposed closer to gap parts 13 than data electrodes 9. With this structure, a priming discharge is performed between auxiliary electrodes 17 and priming electrodes 14 formed on back substrate 2 side. Priming electrodes 14 and auxiliary electrodes 17 are parallel with each other; however, as shown in line C—C of FIG. 1, it is preferable that their center lines agree with each other.

In the present embodiment, as shown in FIG. 1, in priming discharge spaces 30 on back substrate 2, material layer 5 having a high secondary electron emission factor is formed with a nearly uniform thickness onto dielectric layer 16 covering priming electrodes 14. Material layer 5 can be made of at least one of alkali metal oxide ($Cs_2O$, etc.), alkaline earth metal oxide (MgO, CaO, SrO, BaO, etc.) and fluoride (LiF, $CaF_2$, $MgF_2$, etc.). In the present embodiment, material layer 5 is made of material whose main component is MgO, which is field proven as material for AC type PDPs, and which has a high secondary electron emission factor and excellent durability when neon (Ne) and xenon (Xe) gases are sealed. Therefore, material layer 5 has a function of effectively emitting secondary electrons into priming discharge spaces 30 therefrom when a voltage is applied between priming electrodes 14 and auxiliary electrodes 17. This structure realizes, in the present embodiment, uniform feeding of secondary electrons into priming discharge spaces 30 from material layer 5 continuous in the longitudinal direction of priming discharge spaces 30. This makes it possible to reduce variations in priming discharge in priming discharge spaces 30 having a long and narrow shape, thereby generating a uniform priming discharge towards each of main discharge spaces 11. Furthermore, it becomes possible to stimulate a uniform generation of a priming discharge, thereby reducing a voltage to be applied on a priming discharge.

In the present embodiment, priming electrodes 14 are covered with dielectric layer 16; however, it is possible that material layer 5 is formed directly onto priming electrodes 14, without providing dielectric layer 16.

A method for displaying image data on the PDP will be described as follows with reference to FIG. 5.

In order to drive the PDP, one field period is divided into a plurality of sub fields having a weight of an illumination period based on the binary system, and a gradation display is performed by a combination of sub fields during which to illuminate phosphors. Each sub field consists of an initialization period, an address period and a sustain period.

Figure 5:
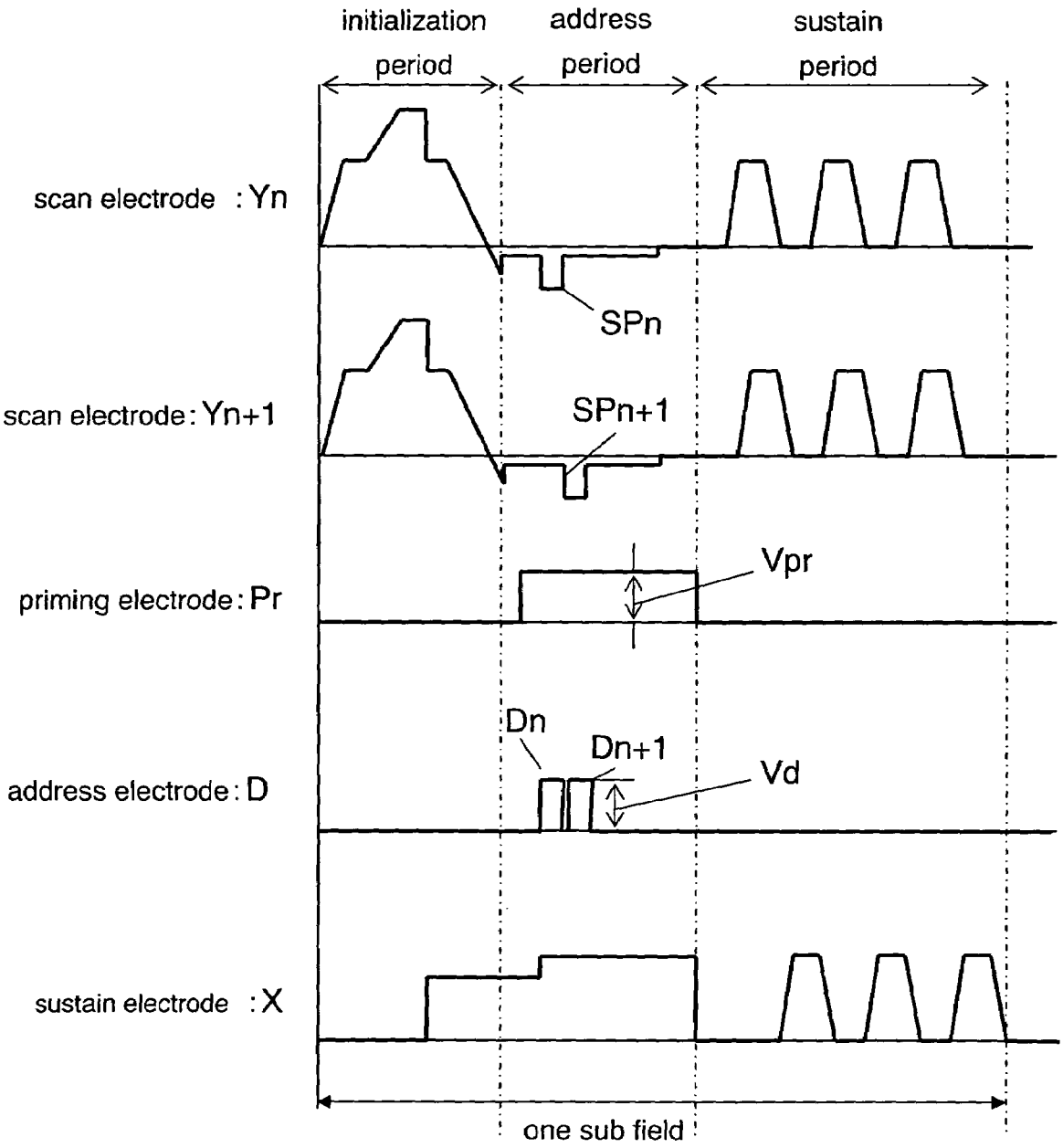
FIG. 5 is a waveform chart showing an example of waveforms for driving the PDP according to the first embodiment of the present invention.

FIG. 5 is a waveform chart showing an example of waveforms for driving the PDP according to the present invention. First of all, during the initialization period, in priming discharge spaces (priming discharge spaces 30 shown in FIG. 1) including priming electrodes Pr (priming electrodes 14 shown in FIG. 1), all scan electrodes Y (scan electrodes 6 shown in FIG. 1) are applied with a positive pulse voltage so as to perform an initialization between auxiliary electrodes (auxiliary electrodes 17 shown in FIG. 1) and priming electrodes Pr (priming electrodes 14 shown in FIG. 1). During the subsequent address period, priming electrodes Pr are constantly applied with a positive potential. Consequently, in the priming discharge spaces, when scan electrode $Y_n$ is applied with scan pulse $SP_n$, a priming discharge occurs between priming electrodes Pr and the auxiliary electrodes.

Then, scan electrode $Y_{n+1}$ of the n+1th discharge cell is applied with scan pulse $SP_{n+1}$; however, since a priming discharge has occurred immediately before this, a discharge delay in the addressing of the n+1th discharge cell can be reduced. Although the driving sequence in one sub field has been described hereinbefore, the other sub fields have the same operation principle. In the drive waveforms shown in FIG. 5, applying a positive voltage to priming electrodes Pr during the address period can perform the aforementioned operations more securely. The voltage to be applied to priming electrodes Pr during the address period is preferably set to a larger value than a data voltage value to be applied to address electrodes D.

As described hereinbefore, in the present embodiment, a priming discharge is generated in the vertical direction between auxiliary electrodes 17 provided on front substrate 1 and priming electrodes 14 provided on back substrate 2. Moreover, material layer 5 having a high secondary electron emission factor is formed in priming discharge spaces 30 on back substrate 2. Thus, although the electrons emitted from auxiliary electrodes 17 hit material layer 5 on back substrate 2 side, since material layer 5 is made of material having a high secondary electron emission factor, it is possible to emit secondary electrons from material layer 5 and to supply them into priming discharge spaces 30, thereby stimulating the discharge while making priming discharge generation uniform.

Consequently, while securing the conventional operating margin, discharge intensity can be diminished by decreasing a discharge voltage, thereby reducing influence of a priming discharge on the surroundings, such as crosstalk. In a case that the same discharge voltage as in the conventional PDPs is applied, the discharge operating margin can be larger than in the conventional cases. It goes without saying that adjusting the applied voltage can bring about both the effect of reducing crosstalk and the effect of increasing the operating margin. This results in more stabilized address properties in a PDP with high definition.

Second Exemplary Embodiment

Figure 6:
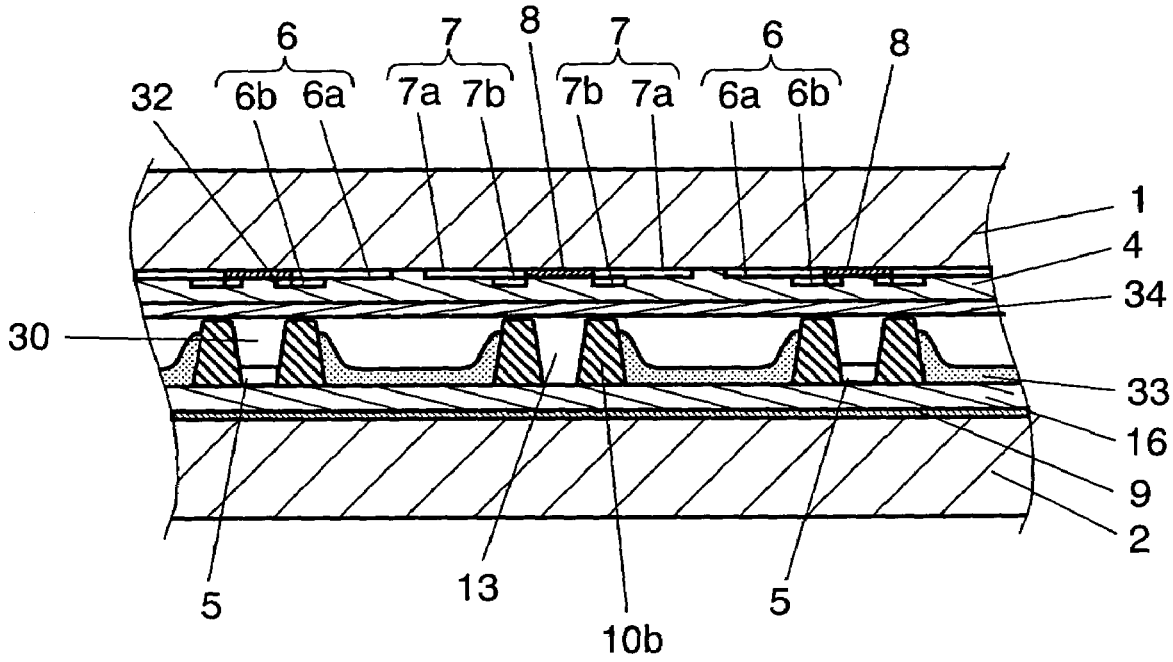
FIG. 6 is a cross sectional view showing a PDP according to a second embodiment of the present invention.
Figure 7:
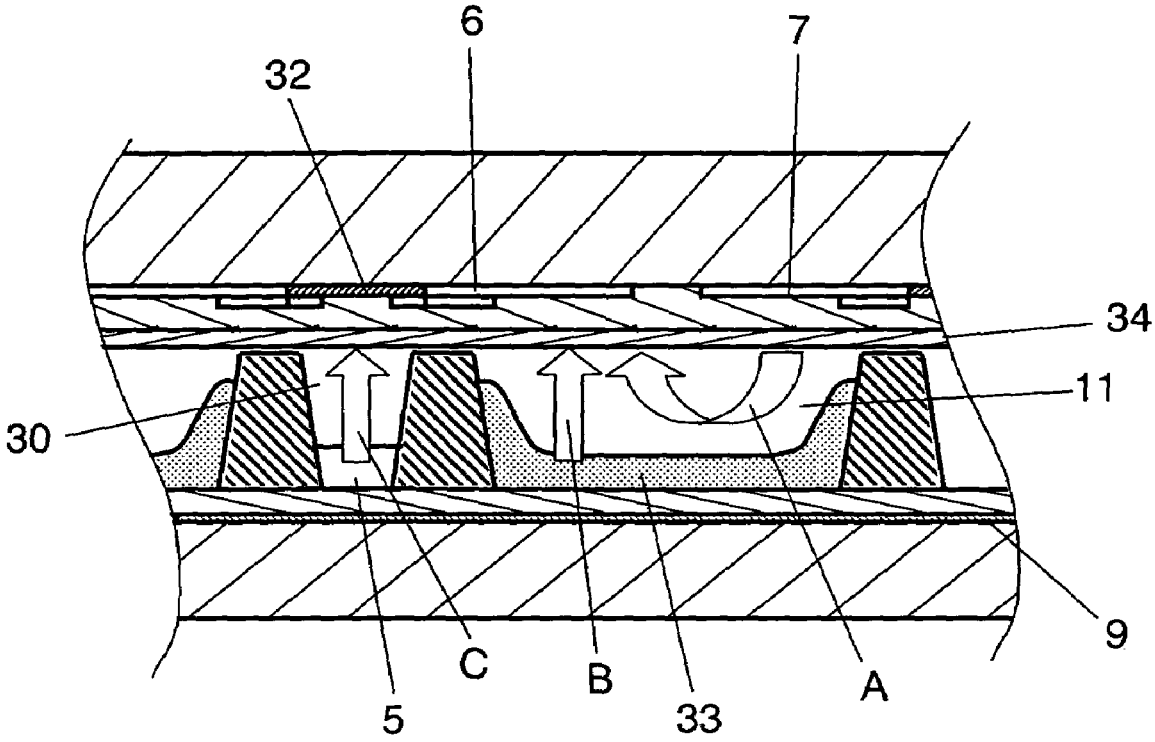
FIG. 7 is a cross sectional view depicting a discharge operation of the PDP according to the second embodiment of the present invention.

FIG. 6 is a cross sectional view showing a PDP according to a second embodiment of the present invention, and FIG. 7 is a cross sectional view depicting a discharge operation according to the second embodiment of the present invention.

The following is a description about the difference between the present embodiment and the first embodiment shown in FIG. 1. In the first embodiment, priming electrodes 14 are provided in priming discharge spaces 30 on back substrate 2, and during the address period, a priming discharge is formed between priming electrodes 14 and auxiliary electrodes 17 connected with scan electrodes 6. In the second embodiment shown in FIG. 6, on the other hand, no priming electrodes are provided in priming discharge spaces 30 on back substrate 2, and a priming discharge is performed during the initialization period between auxiliary electrodes 32 extended from scan electrodes 6, and data electrodes 9. Thus, the difference from the first embodiment is the absence of priming electrodes on back substrate 2, and the other structure is the same including the formation of material layer 5 having a high secondary electron emission factor in priming discharge spaces 30.

FIG. 7 is a view for depicting the significance of generating a priming discharge during the initialization period, particularly during the first half of the initialization period between data electrodes 9 and auxiliary electrodes 32, and the present embodiment will be described as follows with reference to FIG. 7.

As shown in FIG. 7, discharges during the first half of the initialization period involve three discharges: discharge A using scan electrodes 6 in main discharge spaces 11 as anodes and sustain electrodes 7 as cathodes; discharge B using scan electrodes 6 in main discharge spaces 11 as anodes and data electrodes 9 as cathodes; and discharge C using auxiliary electrodes 32 in priming discharge spaces 30 as anodes and data electrodes 9 as cathodes. In FIG. 7, discharges A, B and C are indicated with the arrows going from the cathode side to the anode side. Since the object of an initialization discharge is to adjust a wall voltage in main discharge spaces 11, all which is necessary is to stably generate discharges A and B. However, discharge B tends to be not easily generated and to become unstable because phosphor layer 33 having a low secondary electron emission factor is the cathode. In the case of discharge A, protective layer 34 having a high secondary electron emission factor is a cathode; however, it is a surface discharge which less likely occurs than a counter discharge, so that when the partial pressure of, e.g. xenon (Xe) is increased, the discharge may become unstable. On the other hand, in the case of discharge C, material layer 5 having a high secondary electron emission factor is a cathode, and it is a counter discharge, so that it can generate an extremely stable discharge.

Thus, applying voltage Vx to data electrodes 9 generates discharge C prier to the generation of discharge A, and priming generated by discharge C is used to stably generate discharge A. To be more specific, during the first half of the initialization period, before generation of a discharge using scan electrodes 6 in main discharge spaces 11 as anodes and sustain electrodes as cathodes, data electrodes 9 are applied with voltage Vx for generating a discharge using auxiliary electrodes 32 in priming discharge spaces 30 as anodes and data electrodes 9 as cathodes. Since material layers 5 provided in priming discharge spaces 30 decrease the discharge initiation voltage between auxiliary electrodes 32 and data electrodes 9, discharge B never occurs before discharge C.

As described hereinbefore, according to the second embodiment of the present invention, an initializing operation can be generated stably, so that even in a panel with an increased xenon partial pressure in a discharge gas, an initializing discharge can be stabilized so as to provide image display with excellent quality.

INDUSTRIAL APPLICABILITY

A plasma display panel of the present invention stably generates a priming discharge, so that even when high definition is achieved or the partial pressure of xenon (Xe) is increased, an image display with excellent quality can be provided by stabilizing an initializing operation or an address operation. Thus, the panel is useful as a plasma display device used in wall-hung TVs, a large-size monitors, etc.

The invention claimed is:

1. A plasma display panel comprising:

a scan electrode and a sustain electrode which are parallel with each other on a front substrate;

a data electrode on a back substrate in a direction crossing the scan electrode and the sustain electrode, the back substrate facing the front substrate with a discharge space therebetween;

a priming electrode on the back substrate parallel with the scan electrode and the sustain electrode;

a first discharge space and a second discharge space on the back substrate and partitioned apart by a barrier rib; and an auxiliary electrode on an optical absorption layer which is between adjacent scan electrodes and connected to the scan electrode at a non-display portion, wherein the auxiliary electrode connected to the scan electrode is covered with a dielectric layer and a protective layer, the first discharge space is a main discharge space for performing a discharge with the scan electrode, the sustain electrode and the data electrode, and the second discharge space is a priming discharge space for performing a discharge with a positive voltage applied to the priming electrode in the address period between the priming electrode and the auxiliary electrode, and in the priming discharge space, a material layer comprising at least one material selected from the group consisting of alkali metal oxide, alkali metal fluoride, alkaline earth metal oxide, and alkaline earth metal fluoride, on a discharge space side of the priming electrode.

2. The plasma display panel according to claim 1, wherein the material layer comprises MgO.

3. A plasma display panel comprising:

a scan electrode and a sustain electrode which are parallel with each other on a front substrate;

a data electrode on a back substrate in a direction crossing the scan electrode and the sustain electrode, the back substrate facing the front substrate with a discharge space therebetween;

a first discharge space and a second discharge space on the back substrate and partitioned apart by a barrier rib; and an auxiliary electrode on an optical absorption layer which is between adjacent sustain electrodes and extends between adjacent scan electrodes, wherein the auxiliary electrode formed on the optical absorption layers is covered with a dielectric layer and a protective layer, the first discharge space is a main discharge space for performing a discharge with the scan electrode, the sustain electrode and the data electrode, and the second discharge space is a priming discharge space for performing a discharge with a voltage for generating a discharge applied to the data electrode, the auxiliary electrode being an anode and the data electrode being a cathode, between the auxiliary electrode and the data electrode, and in the priming discharge space, a material layer comprising at least one material selected from the group consisting of alkali metal oxide, alkali metal fluoride, alkaline earth metal oxide, and alkaline earth metal fluoride, on the back substrate side.

4. The plasma display panel according to claim 3, wherein the material layer comprises MgO.

* * * * *